US012757933B2

(12) United States Patent
Li et al.

(10) Patent No.: US 12,757,933 B2
(45) Date of Patent: Oct. 13, 2026

(54) ELECTRONIC CIGARETTE

(71) Applicant: AAC ACOUSTIC TECHNOLOGIES (SHENZHEN) CO., LTD., Shenzhen (CN)

(72) Inventors: Jinyang Li, Shenzhen (CN); Tao Fang, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 706 days.

(21) Appl. No.: 18/325,078

(22) Filed: May 29, 2023

(65) Prior Publication Data

US 2024/0292887 A1 Sep. 5, 2024

Related U.S. Application Data

(63) Continuation of application No. PCT/CN2023/090148, filed on Apr. 23, 2023.

(30) Foreign Application Priority Data

Mar. 3, 2023 (CN) ..... 202320471309.3

(51) Int. Cl.
*A24F 40/10* (2020.01)
*A24F 40/53* (2020.01)

(52) U.S. Cl.
CPC ..... *A24F 40/10* (2020.01); *A24F 40/53* (2020.01)

(58) Field of Classification Search
CPC ..... A24F 40/51; A24F 40/40; A24F 40/485; A24F 40/60; A24F 40/42; A24F 40/46; A24F 40/50; A24F 40/53; A24F 47/00; A24F 7/02; A24F 40/05; A24F 40/44; A24F 40/48; A24F 40/65; H04R 19/04; H04R 19/00; H04R 2201/003; H04R 2460/13; H04R 1/04; H04R 19/005; H04R 3/00; H04R 1/2884; H04R 1/38; H04R 2410/03; H04R 9/02; H04R 9/06; G01H 11/06; G01H 3/00; A24B 15/167; G01L 9/0041;

(Continued)

(56) References Cited

U.S. PATENT DOCUMENTS

2021/0077752 A1* 3/2021 Buchberger ..... A24F 40/485

OTHER PUBLICATIONS

Zhang, CN 210112277 U (Year: 2020).*
Zeng, WO 2022000794 A1 (Year: 2022).*

* cited by examiner

*Primary Examiner* — Vy T Nguyen
(74) *Attorney, Agent, or Firm* — Wiersch Law Group

(57) ABSTRACT

An electronic cigarette includes an atomizer, an e-liquid cavity, and an airflow sensing device. The airflow sensing device includes a first circuit board, a MEMS airflow sensor, and a main control IC. A second control board includes a first bonding pad and a second bonding pad. The second bonding pad is disposed around the first bonding pad. The first bonding pad includes a first pin and the second bonding pad includes a second pin. Since the first bonding pad is surrounded and sealed by the second bonding pad, the first pin is electrically connected to a capacitance detection port of the main control IC, and the second pin is grounded, condensate is prevented from contacting the first pin, thus preventing the condensate from flowing through a capacitance detection circuit. The main control IC does not detect an increase in capacitance value, which prevent the electronic cigarette from self-starting.

5 Claims, 6 Drawing Sheets

(58) Field of Classification Search
CPC ..... H05K 1/0272; H05K 1/183; H05K 2201/09018; H05K 2201/09072; H05K 2201/10083; H05K 2201/10151; H05K 2201/10522; H05K 7/1427; H05B 1/0202; H05B 1/0244; H05B 3/0014; H05B 3/748
USPC ..... 131/328, 329; 257/417; 438/51; 392/387, 390, 395
See application file for complete search history.

ELECTRONIC CIGARETTE

TECHNICAL FIELD

The present disclosure relates to a technical field of sensors, and in particular to an electronic cigarette.

BACKGROUND

In the prior art, an electronic cigarette mainly comprises an atomizer and an airflow sensing device. The airflow sensing device, as an air switch for the electronic cigarette, is widely used. The airflow sensing device generally comprises an airflow sensor and a control circuit electrically connected to the airflow sensor.

When using the electronic cigarette, the air passes through the airflow sensor, making a conductive film of the airflow sensor to deform, thereby causing a change in an equivalent capacitance. When the change reaches a certain value, the airflow sensing device generates a signal to power an atomizing core of the atomizer, making the atomizer to work.

The airflow sensor comprises a micro-electro-mechanical system (MEMS) chip and a printed circuit board (PCB). In addition to the control circuit and the airflow sensor, the airflow sensing device generally comprises an integrated circuit (IC) chip having a capacitance detection function.

A conventional PCB of the airflow sensor is shown in FIG. 1, where one of an A pin and a B pin is connected to a capacitance detection port of the IC chip, the other one of the A pin and the B pin is grounded, and a C pin is grounded. However, when using the electronic cigarette, an aerosol may flow back into a cavity of the electronic cigarette, and some of the aerosol condense on a surface of the cavity. Eventually, condensate would contact the PCB. In this case, there is condensate on a capacitance detection circuit of the conventional PCB of the electronic cigarette, making the IC chip detect an increase in a capacitance value, which leads to self-starting of the electronic cigarette and brings a great safety hazard.

SUMMARY

A purpose of the present disclosure is to provide an electronic cigarette that prevents condensate from entering a capacitance detection circuit and prevents electronic cigarette from self-starting.

The present disclosure provides the electronic cigarette. The electronic cigarette comprises a housing, an atomizer accommodated in the housing, an e-liquid cavity, and an airflow sensing device disposed on a bottom end of the housing.

A smoking port is defined on a top end of the housing. The atomizer is spaced apart from the smoking port. The e-liquid cavity is disposed between the atomizer and the smoking port. A through hole communicated with an outside is defined on the bottom end of the housing.

The airflow sensing device comprises a first circuit board fixed to the bottom end of the housing, a micro-electro-mechanical system (MEMS) airflow sensor fixed to the first circuit board, and a main control integrated circuit (IC) electrically connected to the first circuit board. The MEMS airflow sensor comprises a second circuit board. The second circuit board is electrically connected to the first circuit board.

A first bonding pad and a second bonding pad are disposed in the second circuit board. The second bonding pad is a closed ring-shaped structure. The second bonding pad is disposed around an outer side of the first bonding pad. The first bonding pad comprises a first pin. The second bonding pad comprises a second pin. The main control IC is electrically connected to the second circuit board through the first pin. The second pin is grounded.

Furthermore, the first bonding pad is recessed in a direction away from the first circuit board. The second bonding pad is recessed in a direction away from the first circuit board.

Furthermore, the first bonding pad and the second bonding pad are electrically connected to the first circuit board and the second circuit board by solder paste.

Furthermore, the first bonding pad and the second bonding pad are spaced apart.

Furthermore, the MEMS airflow sensor further comprises a shell and a MEMS chip. The shell is fixed to one side of the second circuit board away from the first circuit board. The shell defines an accommodating cavity. The MEMS chip is electrically connected to the second circuit board and fixed in the accommodating cavity. The shell defines a first air hole communicated with the smoking port. The second circuit board defines a second air hole communicated with the first air hole. The MEMS chip directly faces the second air hole.

Furthermore, the first circuit board is defines a third air hole communicated with the second air hole. On a joint of the first circuit board and the second circuit board, a waterproof material is coated on a periphery of the third air hole and a periphery of the second air hole.

Furthermore, the airflow sensing device further comprises a waterproof sleeve sleeved on the shell. The waterproof sleeve defines a fourth air hole communicated with the first air hole.

Furthermore, the MEMS airflow sensor comprises a first connecting line and a second connecting line. The first connecting line and the second connecting line are electrically connected to the MEMS chip. The first connecting line is electrically connected to the first bonding pad, and the second connecting line is electrically connected to the second bonding pad.

The electronic cigarette comprises the atomizer, the e-liquid cavity, and the airflow sensing device. The airflow sensing device comprises the first circuit board, the MEMS airflow sensor, and an application-specific integrated circuit (ASIC) chip. When the atomizer is working, an airflow flows into the electronic cigarette from the through hole, and passes through the MEMS airflow sensor. A conductive film of the MEMS airflow sensor is deformed to cause a change of an equivalent capacitance, then a capacitance change signal is transmitted to the main control IC, and the main control IC generates a control signal according to the capacitance change signal. Finally, power is applied to an atomizing core of the atomizer, so that the atomizer works. The atomizer atomizes e-liquid in the e-liquid cavity, and atomized e-liquid is mixed with the airflow flowing from the through hole to form an aerosol. The aerosol flows out of the smoking port. However, when using a conventional electronic cigarette, the aerosol may flow back into a cavity of the conventional electronic cigarette, some of the aerosol are condensed on a surface of the cavity, and condensate is finally in contact with a control circuit board thereof.

Therefore, in the present disclosure, the first bonding pad and the second bonding pad are disposed in the second circuit board. The second bonding pad is disposed around the first bonding pad. The first bonding pad comprises the first pin. The second bonding pad comprises the second pin.

The main control IC is electrically connected to the second circuit board through the first pin. The second pin is grounded. Since the first bonding pad corresponding to the first pin of the MEMS airflow sensor electrically connected to the main control IC is surrounded by the second bonding pad corresponding to the second pin of the MEMS airflow sensor grounded, the condensate is prevented from contacting the first pin of the MEMS airflow sensor electrically connected to the main control IC, thereby effectively preventing the condensate from flowing through the capacitance detection circuit of the electronic cigarette. Thus, the main control IC does not detect an increase in a capacitance value, preventing the electronic cigarette from self-starting. Therefore, the electronic cigarette of the present disclosure is safe, reliable and low cost.

DETAILED DESCRIPTION

Figure 1:
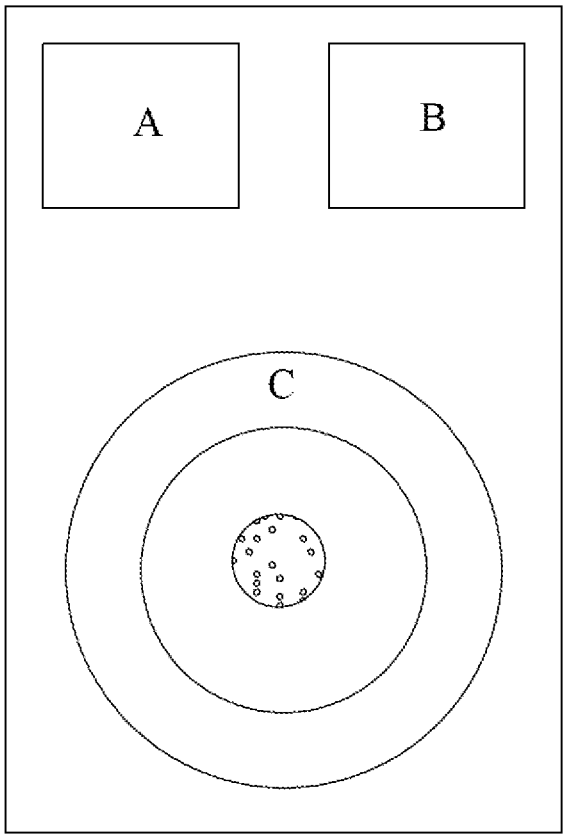
FIG. 1 Prior art
FIG. 1 is a schematic diagram of a conventional PCB of an airflow sensor in the prior art.

The present disclosure is further described below in conjunction with the accompanying drawings and embodiments.

As shown in FIGS. 2-6, an electronic cigarette is provided. The electronic cigarette comprises a housing 1, an atomizer 2 accommodated in the housing 1, an e-liquid cavity 3, and an airflow sensing device 4 disposed on a bottom end of the housing 1. A smoking port 10 is defined on a top end of the housing 1. The atomizer 2 is spaced apart from the smoking port 10. The e-liquid cavity 10 is disposed between the atomizer 2 and the smoking port 10. A through hole (not shown in the drawings) communicated with an outside is defined on the bottom end of the housing 1.

The airflow sensing device 4 comprises a first circuit board 41 fixed to the bottom end of the housing 1, a micro-electro-mechanical system (MEMS) airflow sensor 42 fixed to the first circuit board 41, and a main control integrated circuit (IC) electrically connected to the first circuit board 41. The MEMS airflow sensor 42 comprises a second circuit board 421. The second circuit board 421 is electrically connected to the first circuit board 41. A first bonding pad 4211 and a second bonding pad 4212 are disposed in the second circuit board 421. The second bonding pad 4212 is a closed ring-shaped structure. The second bonding pad 4212 is disposed around an outer side of the first bonding pad 4211. The first bonding pad 4211 comprises a first pin 4211A. The second bonding pad 4212 comprises a second pin 4212A. The main control IC is electrically connected to the second circuit board 421 through the first pin 4211A. The second pin 4212A is grounded.

The electronic cigarette comprises the atomizer 2, the e-liquid cavity 3, and the airflow sensing device 4. The airflow sensing device 4 comprises the first circuit board 41, the MEMS airflow sensor 42, and an application-specific integrated circuit (ASIC) chip. When using the atomizer 2, an airflow flows into the electronic cigarette from the through hole, and passes through the MEMS airflow sensor 42. A conductive film 4231 of the MEMS airflow sensor is deformed to cause a change of an equivalent capacitance, then a capacitance change signal is transmitted to the main control IC, and the main control IC generates a control signal according to the capacitance change signal. Finally, power is applied to an atomizing core of the atomizer 2, so that the atomizer 2 works. The atomizer 2 atomizes e-liquid in the e-liquid cavity 3, and atomized e-liquid is mixed with the airflow flowing from the through hole to form an aerosol. The aerosol flows out of the smoking port 10. However, when using a conventional electronic cigarette, the aerosol may flow back into a cavity of the conventional electronic cigarette, some of the aerosol are condensed on a surface of the cavity, and condensate is finally in contact with a control circuit board thereof.

Therefore, in the present disclosure, the first bonding pad 4211 and the second bonding pad 4212 are disposed in the second circuit board 421. The second bonding pad 4212 is disposed around the first bonding pad 4211. The first bonding pad 4211 comprises the first pin 4211A. The second bonding pad 4212 comprises the second pin 4212A. The main control IC is electrically connected to the second circuit board 421 through the first pin 4211A. The second pin 4212A is grounded. Since the first bonding pad 4211 corresponding to the first pin 4211A of the MEMS airflow sensor 42 electrically connected to the main control IC is surrounded by the second bonding pad 4212 corresponding to the second pin 4212A of the MEMS airflow sensor 42 grounded, the condensate is prevented from touching the first pin 4211A of the MEMS airflow sensor 42 electrically connected to the main control IC, thereby effectively preventing the condensate from flowing through the capacitance detection circuit of the electronic cigarette. Thus, the main control IC does not detect an increase in a capacitance value, preventing the electronic cigarette from self-starting. Therefore, the electronic cigarette of the present disclosure is safe, reliable and low cost.

Furthermore, the first bonding pad 4211 is recessed in a direction away from the first circuit board 41. The second bonding pad 4212 is recessed in a direction away from the first circuit board 41.

Specifically, in the embodiment, the first bonding pad 4211 is a rectangular structure, and the second bonding pad 4212 is a rectangular ring-shaped structure enclosing the rectangular structure. The first bonding pad 4211 of the MEMS airflow sensor 42 is connected via the first pin 4211A. Since the first pin 4211A is connected to a capacitance detection port of the main control IC, an electrical connection relationship between the MEMS airflow sensor 42 and the capacitance detection port of the main control IC is realized. Meanwhile, the second bonding pad 4212 of the MEMS airflow sensor 42 is connected via the second pin 4212A. Since the second pin 4212A is grounded, the MEMS airflow sensor 42 is grounded. In a working process of the electronic cigarette, when the airflow passes through the MEMS airflow sensor 42 to deform the conductive film 4231 of the MEMS airflow sensor 42, the MEMS airflow sensor 42 transmits the capacitance change signal to the capacitance detection port of the main control IC through the first pin 4211A, so that the main control IC generates the control signal according to the capacitance change signal, and then transmit the control signal to the atomizer 2. Finally, the power is applied to the atomizing core of the atomizer 2, so that the atomizer 2 works. The atomizing core of the atomizer 2 obtains a corresponding instruction to atomize the e-liquid, and finally realizes an operation of the electronic cigarette.

In other embodiments, the first bonding pad 4211 may be a circular structure, a square structure, a triangular structure, a pentagonal structure, a hexagonal structure, etc. The second bonding pad 4212 may be a circular ring-shaped structure, a square ring-shaped structure, a triangular ring-shaped structure, a pentagonal ring-shaped structure, a hexagonal ring-shaped structure, etc.

Furthermore, the first bonding pad 4211 and the second bonding pad 4212 are electrically connected to the first circuit board 41 and the second circuit board 421 by solder paste. Furthermore, the first bonding pad and the second bonding pad are spaced apart.

Specifically, the first circuit board 41 is a PCB board of the electronic cigarette, and the second circuit board 421 is a PCB board of the MEMS airflow sensor 42. When assembling the electronic cigarette, the first circuit board 41 and the second circuit board 421 are electrically connected by the solder paste. Specifically, the solder paste is pasted to the first bonding pad 4211 and the second bonding pad 4212 of the second circuit board 421. Then the first circuit board 41 and the second circuit board 421 are attached to each other, so that a joint of the first circuit board 41 and the second circuit board 421 is sealed by the solder paste.

The second bonding pad 4212 of the second circuit board 421 is disposed around the first bonding pad 4211, and the first bonding pad 4211 and the second bonding pad are spaced apart, so that after the first circuit board 41 and the second circuit board 421 are connected, and the first pin 4211A of the first bonding pad 4211 is sealed and protected. The first pin 4211A is connected to the capacitance detection port of the main control IC, and the second pin 4212A is grounded. Therefore, when using the electronic cigarette, the condensate is effectively prevented from contacting the first pin 4211A of the MEMS airflow sensor 42 connected to the main control IC, thereby preventing the condensate from flowing through the capacitance detection circuit of the electronic cigarette. Thus, the main control IC does not detect the increase of the capacitance value, thereby preventing the electronic cigarette from self-starting. Therefore, electronic cigarette is safe, reliable, and low in cost.

Figure 2:
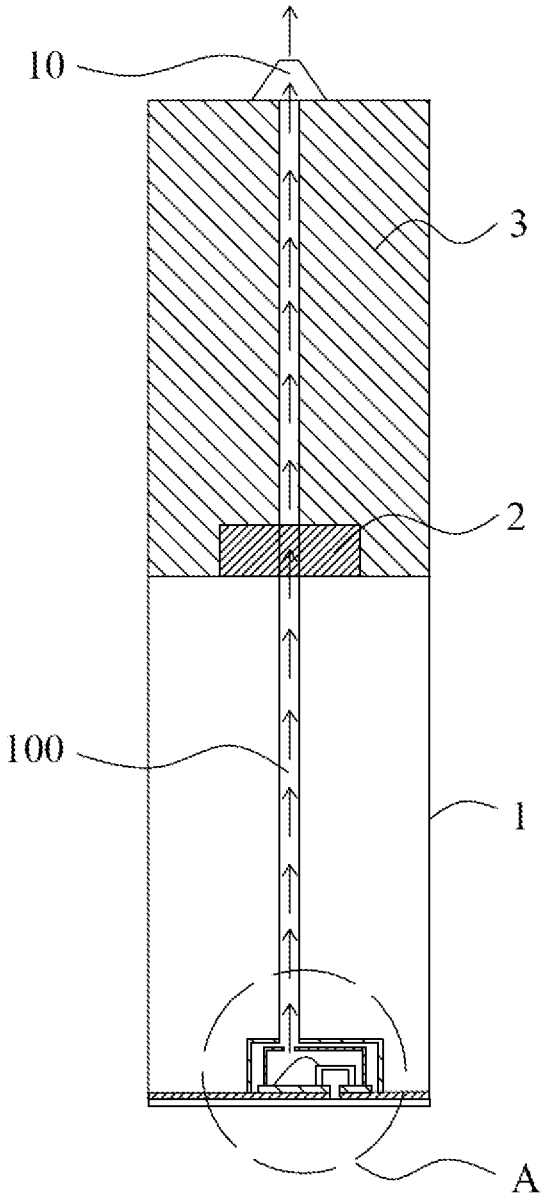
FIG. 2 is a cross-sectional schematic diagram of an electronic cigarette of the present disclosure.
Figure 3:
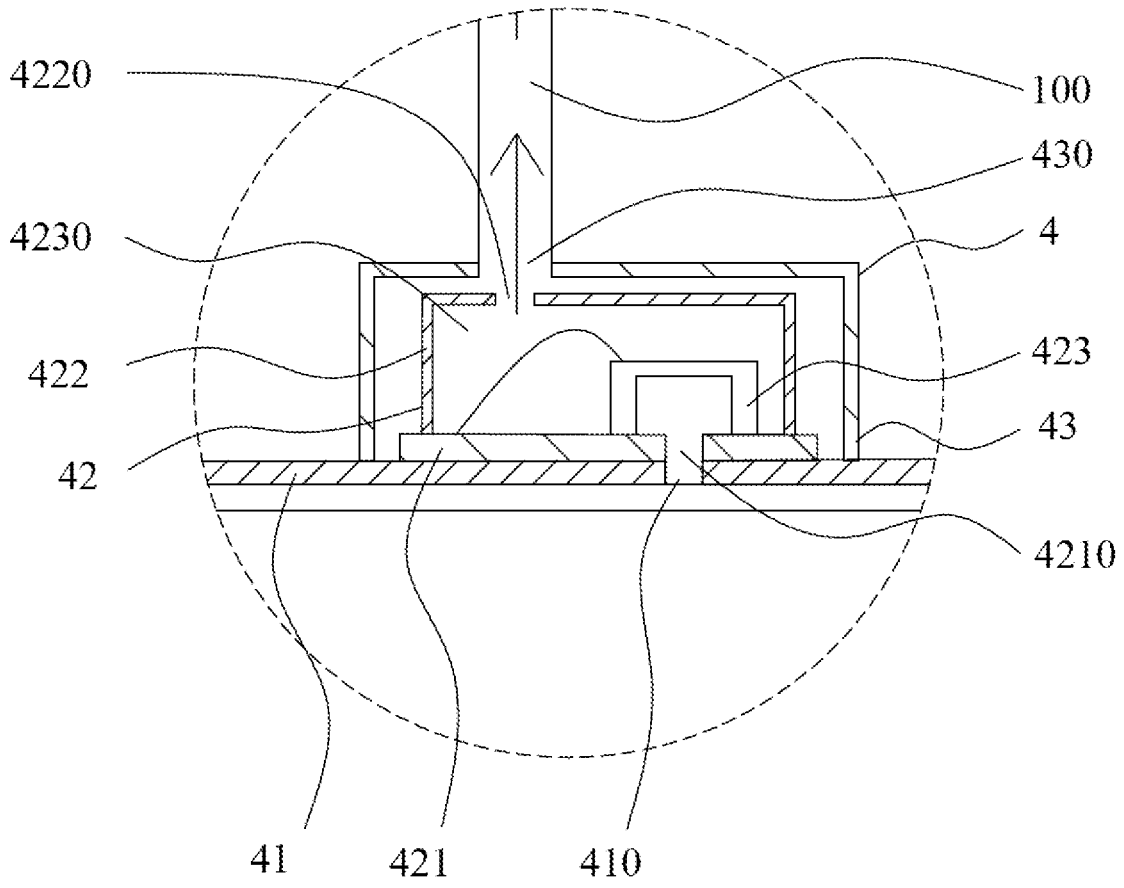
FIG. 3 is an enlarged schematic diagram of detail A shown in FIG. 2.

Furthermore, as shown in FIGS. 2 and 3, the MEMS airflow sensor 42 further comprises a shell 422 and a MEMS chip 423. The shell 422 is fixed to one side of the second circuit board 421 away from the first circuit board 41. The shell 422 defines an accommodating cavity 4230. The MEMS chip 423 is electrically connected to the second circuit board 421 and fixed in the accommodating cavity 4230. The shell 422 defines a first air hole 4220 communicated with the smoking port 10. The second circuit board 421 defines a second air hole 4210 communicated with the first air hole 4220. The MEMS chip 423 directly faces the second air hole 4210. The first circuit board 41 is defines a third air hole 410 communicated with the second air hole 4210.

Specifically, the first air hole 4220 and the second air hole 4210 are staggered. The second air hole 4210 directly faces the third air hole 410. The airflow enters from the through hole defined on the bottom end of the housing 1 of the electronic cigarette, and then sequentially passes through the third air hole 410 and the second air hole 4210 to enter the accommodating cavity 4230 of the shell 422 of the MEMS airflow sensor 42. Then the airflow flows through the conductive film 4231 of the MEMS chip 423, so that the conductive film 4231 of the MEMS chip 423 deforms to cause a capacitance change. On one hand, the airflow enters an airflow channel 100 from the first air hole 4220. On the other hand, when the conductive film 4231 of the MEMS chip 423 deforms to cause the capacitance change, the MEMS chip 423 sends the capacitance change signal to the main control IC. The main control IC generates the control signal according to the capacitance change signal and sends the control signal to the atomizer 2. The atomizer 2 starts to work after receiving the control signal to atomize the e-liquid. The atomized e-liquid is mixed with the airflow flowing to the airflow channel 100 to form the aerosol, and finally flows out from the smoking port 10.

Figure 4:
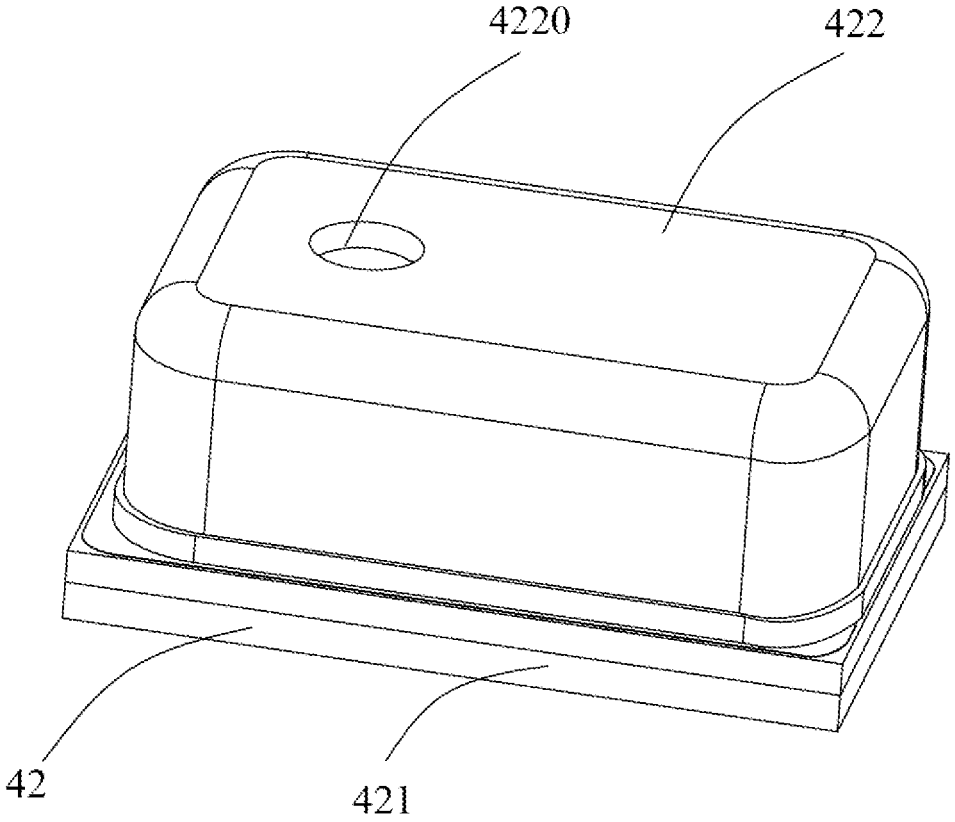
FIG. 4 is a structural schematic diagram of an airflow sensor of the present disclosure.
Figure 5:
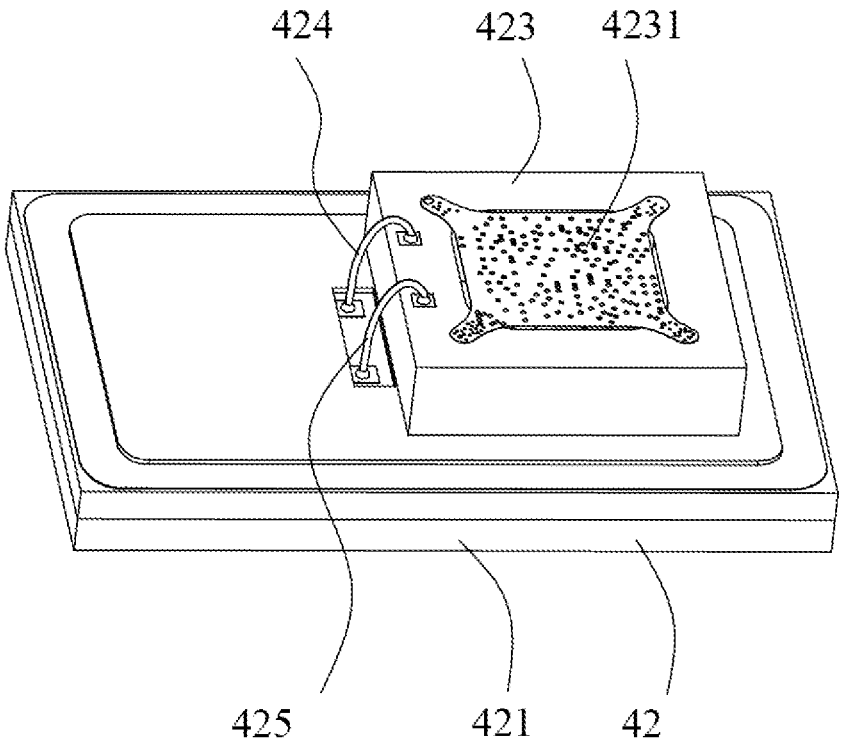
FIG. 5 is a partial schematic diagram of an airflow sensor of the present disclosure.
Figure 6:
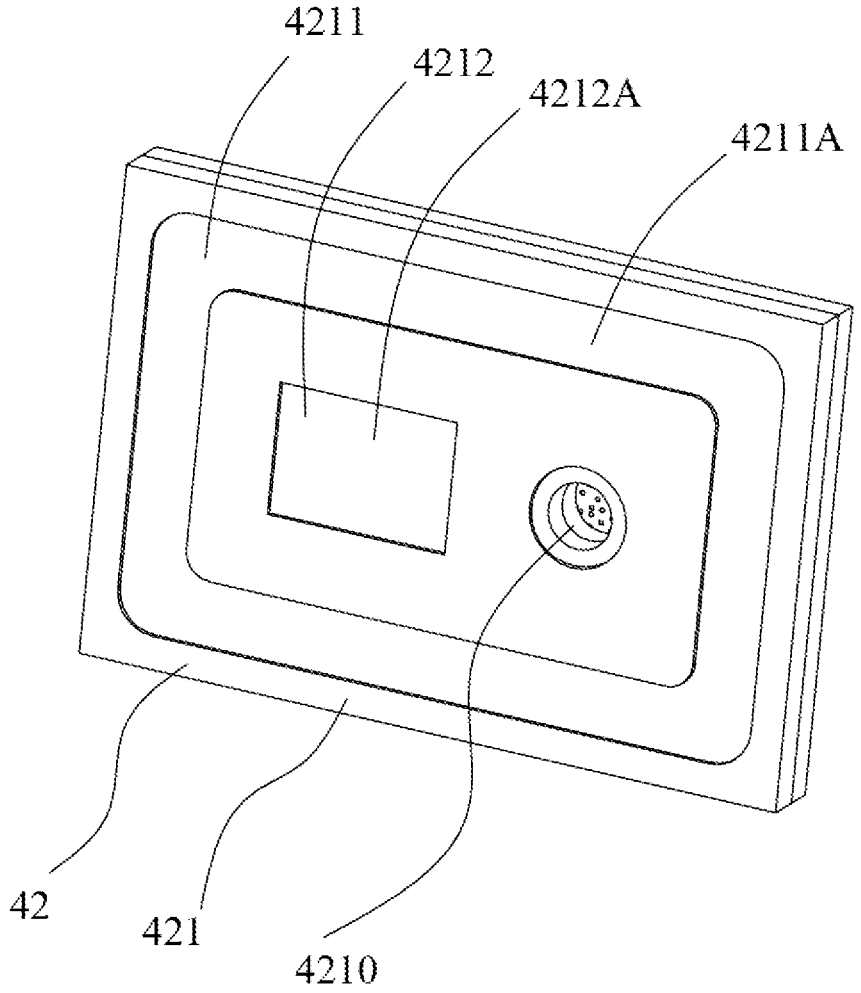
FIG. 6 is a structural schematic diagram of a second circuit board of the airflow sensor of the present disclosure.

Furthermore, as shown in FIGS. 2-4, a waterproof material is coated on a periphery of a joint of the third air hole 410 of the first circuit board 41 and the second air hole 4210 of the second circuit board 421.

Specifically, the waterproof material is waterproof silicone. Generally, the condensate may remain on a front surface of the PCB board (i.e., the first circuit board 41) of the electronic cigarette, so that it is necessary to prevent the capacitance detection circuit of the MEMS airflow sensor 42 from contacting the condensate. That is, it is necessary to prevent the first pin 4211A, of the MEMS airflow sensor 42, connected to the capacitance detection port of the main control IC from contacting the condensate. In the embodiment, because the first bonding pad 4211 corresponding to the first pin 4211A of the MEMS airflow sensor 42 electrically connected to the main control IC is surrounded by the second bonding pad 4212 corresponding to the second pin 4212A of the MEMS airflow sensor 42 grounded, the first bonding a pad is sealed. Thus, even if the condensate remains on the front surface of the first circuit board 41, the condensate does not contact the first bonding pad 4211, so that the capacitance detection circuit of the MEMS airflow sensor 42 is effectively prevented from contacting the condensate, thereby ensuring safe use of the electronic cigarette.

However, in order to realize circulation of the airflow and thus making the electronic cigarette to work normally, the second air hole 4210 and the third air hole 410 need to be provided. In order to prevent the condensate from flowing over a rear surface of the first circuit board 41 then passing through the second air hole 4210 and the third air hole 410, and finally contacting the second bonding pad 4212, the waterproof silicone is coated on a periphery of the second air hole 4210 and a periphery of the third air hole 410 on contact surfaces of the first circuit board 41 and the second circuit board 421. Therefore, even if the condensate flows over the rear surface of the first circuit board 41 and then flows to the second air hole 4210 and the third air hole 410, the condensate does not contact the second bonding pad 4212, which further ensures the safety of using the electronic cigarette.

In other embodiments, the waterproof material may be rubber plastic, galvanized steel plate, etc.

Furthermore, as shown in FIGS. 2 and 3, the MEMS airflow sensor 42 further comprises a waterproof sleeve 43 sleeved on the shell 422. The waterproof sleeve 43 defines a fourth air hole 430 communicated with the airflow channel 100 and the first air hole 4220.

Specifically, the waterproof sleeve 43 is a silicone sleeve, and the silicone sleeve 43 is sleeved on the shell 422 of the MEMS airflow sensor 42, which also effectively prevents condensate from flowing onto the PCB board (i.e., the second circuit board 421) of the MEMS airflow sensor 42, plays a waterproof protective role for the second circuit board 421, and appropriately extends service life of the second circuit board 421, thus extending service life of the electronic cigarette. In other embodiments, the waterproof sleeve 43 may be made of a waterproof material such as rubber plastic.

Furthermore, the MEMS airflow sensor 42 comprises a first connecting line 424 and a second connecting line 425. The first connecting line 424 and the second connecting line 425 are electrically connected to the MEMS chip 423. The first connecting line 424 is electrically connected to the first bonding pad 4211, and the second connecting line 425 is electrically connected to the second bonding pad 4212.

Specifically, both the first connecting line 424 and the second connecting line 425 are metal wires. Two poles of the MEMS chip 423 are respectively connected with the first connecting line 424 and the second connecting line 425. The first connecting line 424 is electrically connected to the first bonding pad 4211, so the first connecting line 424 is then electrically connected to the first pin 4211A of the second circuit board 421. The second connecting line 425 is electrically connected to the second bonding pad 4212, so the second connecting line 425 is then electrically connected to the second pin 4212A of the second circuit board 421. Since the first pin 4211A is connected to the capacitance detection port of the main control IC and the second pin 4212A is grounded, and since the second bonding pad 4212 is a closed ring-shaped structure disposed around the outer side of the first bonding pad 4211, the first bonding pad 4211 is in a sealed state and the condensate does not contact the first pin 4211A, which effectively prevents the capacitance detection circuit of the MEMS airflow sensor 42 from contacting the condensate and ensures the safe use of the electronic cigarette.

The above are only the embodiments of the present disclosure. It should be pointed out that for those of ordinary skill in the art, improvements can be made without departing from the inventive concept of the present disclosure, and these improvements fall within the protection scope of the present disclosure.

What is claimed is:

1. An electronic cigarette, comprising:

a housing, an atomizer accommodated in the housing;

an e-liquid cavity, and an airflow sensing device disposed on a bottom end of the housing;

wherein a smoking port is defined on a top end of the housing; the atomizer is spaced apart from the smoking port; the e-liquid cavity is disposed between the atomizer and the smoking port; a through hole communicated with an outside is defined on the bottom end of the housing;

wherein the airflow sensing device comprises a first circuit board fixed to the bottom end of the housing, a micro-electro-mechanical system (MEMS) airflow sensor fixed to the first circuit board, and a main control integrated circuit (IC) electrically connected to the first circuit board; the MEMS airflow sensor comprises a second circuit board; the second circuit board is electrically connected to the first circuit board;

wherein the second circuit board is stacked and fixed onto the first circuit board; the second circuit board comprises a first surface facing the first circuit board, a first bonding pad and a second bonding pad are disposed in the first surface of the second circuit board; the second bonding pad is a closed ring-shaped structure; the second bonding pad is disposed around an outer side of the first bonding pad; the first bonding pad comprises a first pin; the second bonding pad comprises a second pin; the main control IC is electrically connected to the second circuit board through the first pin; the second pin is grounded;

wherein the first bonding pad is recessed in a direction away from the first circuit board; the second bonding pad is recessed in a direction away from the first circuit board; the first bonding pad and the second bonding pad are spaced apart: the first bonding pad and the second bonding pad are electrically connected to the first circuit board and the second circuit board by solder paste, such that the second circuit board seals the first circuit board to prevent condensate generated during use of the electronic cigarette from contacting the first pin within the first circuit board.

2. The electronic cigarette according to claim 1, wherein the MEMS airflow sensor further comprises a shell and a MEMS chip; the shell is fixed to one side of the second circuit board away from the first circuit board; the shell defines an accommodating cavity; the MEMS chip is electrically connected to the second circuit board and fixed in the accommodating cavity;

the shell defines a first air hole communicated with the smoking port; the second circuit board defines a second air hole communicated with the first air hole; the MEMS chip directly faces the second air hole.

3. The electronic cigarette according to claim 2, wherein the first circuit board is defined a third air hole communicated with the second air hole; on a joint of the first circuit board and the second circuit board, a waterproof material is coated on a periphery of the third air hole and a periphery of the second air hole.

4. The electronic cigarette according to claim 2, wherein the airflow sensing device further comprises a waterproof sleeve sleeved on the shell; the waterproof sleeve defines a fourth air hole communicated with the first air hole.

5. The electronic cigarette according to claim 2, wherein the MEMS airflow sensor comprises a first connecting line and a second connecting line; the first connecting line and the second connecting line are electrically connected to the MEMS chip; the first connecting line is electrically connected to the first bonding pad, and the second connecting line is electrically connected to the second bonding pad.

* * * * *